US008356539B2

(12) United States Patent
Gonzalez

(10) Patent No.: US 8,356,539 B2
(45) Date of Patent: Jan. 22, 2013

(54) AMMUNITION FEED CHUTE

(76) Inventor: Xavier G. Gonzalez, Mesa, AZ (US)

( * ) Notice: Subject to any disclaimer, the term of this patent is extended or adjusted under 35 U.S.C. 154(b) by 268 days.

(21) Appl. No.: 12/804,660

(22) Filed: Jul. 27, 2010

(65) Prior Publication Data

US 2012/0152094 A1 Jun. 21, 2012

(51) Int. Cl.
*F41A 9/61* (2006.01)

(52) U.S. Cl. ..... 89/33.2; 89/33.14; 89/34

(58) Field of Classification Search ..... 89/33.2, 89/33.14, 34
See application file for complete search history.

(56) References Cited

U.S. PATENT DOCUMENTS 2,449,849 A * 9/1948 Holmes ..... 193/25 AC
2,477,264 A 7/1949 Pearson et al.
2,488,679 A * 11/1949 Nobles ..... 193/25 AC
2,838,154 A * 6/1958 Van Fossen ..... 193/25 AC
2,890,779 A * 6/1959 Aumann ..... 193/25 AC
2,953,230 A * 9/1960 Aumann ..... 193/25 AC
3,250,360 A * 5/1966 Correll ..... 193/25 AC
3,307,452 A * 3/1967 Meunier ..... 89/33.14
3,788,189 A * 1/1974 Sachleben et al. ..... 89/34
4,662,263 A * 5/1987 Titemore et al. ..... 89/33.14
5,471,904 A * 12/1995 Armstrong ..... 89/33.14

* cited by examiner

*Primary Examiner* — Michelle Clement
(74) *Attorney, Agent, or Firm* — Bennet K. Langlotz; Langlotz Patent & Trademark Works, Inc.

(57) ABSTRACT

An ammunition feed chute has a plurality of feed chute links releasably connected together. The feed chute links have interior surfaces that define a guide path for belted ammunition. Each of the feed chute links has a transitional surface attached to one of the feed chute link's interior surfaces, the transitional surfaces each extending from the interior surface to which it is attached to a location where it overlaps the adjacent feed chute link's transitional surface. A tongue extending from one of the feed chute links may be received by a slot in an adjacent feed chute link to releasably connect the feed chute links together. The ligaments may each receive the top insert and the rivet of one of the feed chute links within their closed slots and removably receive the top insert, AN washer, and rivet of an adjacent feed chute link within their open slots to releasably connect the feed chute links together.

10 Claims, 10 Drawing Sheets

AMMUNITION FEED CHUTE

FIELD OF THE INVENTION

The present invention relates to an ammunition feed chute for feeding belted ammunition from a magazine to a mini gun, and more particularly to a flexible and durable feed chute that operates reliably and which can be taken apart and serviced without tools.

BACKGROUND OF THE INVENTION

Feed chutes are chutes or passages through which ammunition is guided into the breech mechanism of a machine gun or mini gun (which is a Gatling type gun having an unusually high rate of fire of 3000-6000 rounds per minute). It is often desirable to supply belted ammunition to machine guns via a feed chute in order to avoid jamming problems at the gun feeder mechanism that could potentially be caused by routing the ammunition belt through one or more sharp turns. An ammunition belt is a device used to retain and feed cartridges into a firearm, typically a machine gun or other automatic weapon. Belt-fed systems minimize the proportional weight of the ammunition to the feeding device along with allowing high rates of continuous fire from the machine gun for extended periods without reloading.

Belts were originally composed of canvas or cloth with pockets spaced evenly to allow the belt to be mechanically fed into the gun. These designs were prone to malfunctions due to the effects of oil and other contaminants altering the belt. Later belt designs used permanently connected metal links to retain the cartridges during feeding. These belts were more tolerant to exposure to solvents and oil but retained the limitation of being a fixed length or capacity. Many weapons designed to use non-disintegrating or canvas belts are provided with machines to automatically reload these belts with loose rounds or rounds held in stripper clips. In use during World War I, reloaders allowed ammunition belts to be recycled quickly to allow practically continuous fire.

Most modern ammunition belts use disintegrating links. Disintegrating links retain a single round and are articulated and connected with the round ahead of it in the belt. When the round ahead is stripped from the belt and fed into the feed system or chamber, the link holding it is ejected, and the link holding the following round is disarticulated. An advantage of this design is the ability to create belts of any length. Some weapons, such as the M134 mini gun and related designs, use a hybrid mechanism to strip rounds from disintegrating belts into a linkless feed system or a specialized delinker to allow for more reliable feeding at extreme rates of fire.

Conventional versions of feed chutes are made entirely from metal. They cannot be easily taken apart without tools in the event a component fails or an ammunition jam occurs. Because they are entirely composed of metal, they are vulnerable to crushing, which then prevents ammunition from flowing freely through the chute. They also have gaps between segments, resulting in small gaps between sheet-metal portions that enable ammunition to jam at those locations. Improperly linked ammunition can also cause jams if the round repositioner has not corrected alignment issues between the cartridge cases and links. This can occur when the link and cartridge have been mislinked with either the link tab positioned below the rim of the cartridge or on the side of the cartridge, thus causing a change in the alignment from the correct position with the link tab in the extractor groove of the case. An example of a known flexible feed chute is U.S. Pat. No. 2,477,264 to Pearson.

It is therefore an object of this invention to provide a flexible and durable ammunition feed chute that operates reliably and which can be taken apart and serviced without tools.

SUMMARY OF THE INVENTION

The present invention provides an improved ammunition feed chute, and overcomes the above-mentioned disadvantages and drawbacks of the prior art. As such, the general purpose of the present invention, which will be described subsequently in greater detail, is to provide an improved ammunition feed chute that has all the advantages of the prior art mentioned above.

To attain this, the preferred embodiment of the present invention essentially comprises a plurality of feed chute links releasably connected together. The feed chute links have interior surfaces that define a guide path for belted ammunition. Each of the feed chute links has a transitional surface attached to one of the feed chute link's interior surfaces, the transitional surfaces each extending from the interior surface to which it is attached to a location where it overlaps the adjacent feed chute link's transitional surface. A tongue extending from one of the feed chute links may be received by a slot in an adjacent feed chute link to releasably connect the feed chute links together. The ligaments may each receive the top insert and the rivet of one of the feed chute links within their closed slots and removably receive the top insert, AN washer, and rivet of an adjacent feed chute link within their open slots to releasably connect the feed chute links together. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1A:
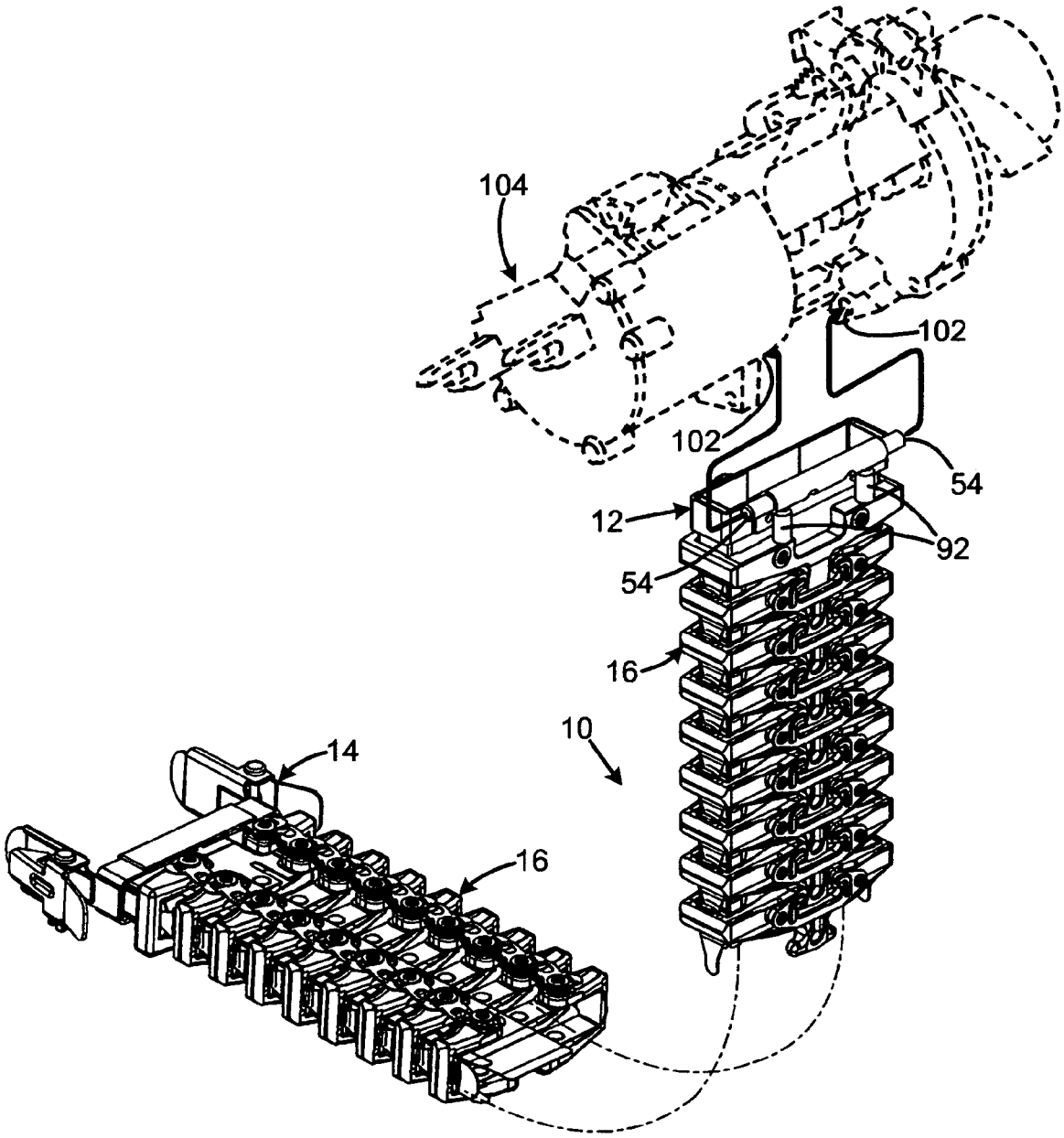
FIG. 1A is a top perspective view of the ammunition feed chute of the present invention constructed in accordance with the principles of the present invention attached to a mini gun feeder/delinker.

An embodiment of the ammunition feed chute of the present invention is shown and generally designated by the reference numeral 10.

Figure 1B:
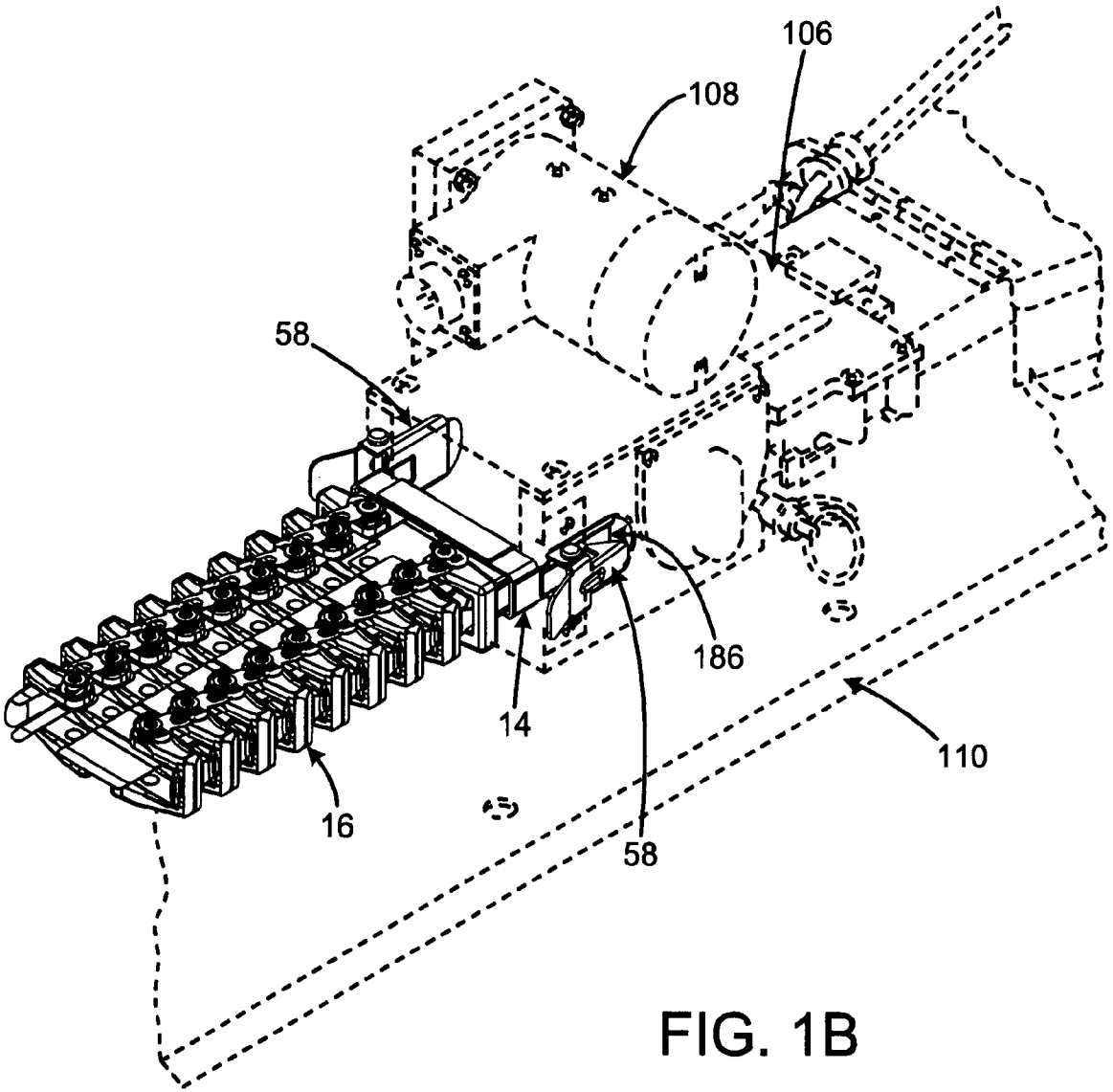
FIG. 1B is a top perspective view of the ammunition feed chute of the present invention constructed in accordance with the principles of the present invention attached to a magazine.

FIGS. 1A and 1B illustrate the ammunition feed chute 10 of the present invention. More particularly, the ammunition feed chute has a plurality of feed chute links 16 that connect a first guide end 12 to a second guide end 14. The feed chute links will be described in more detail in the description of FIGS. 2-5. The ammunition feed chute is shown in use with its first guide end attached to the feeder/delinker 104 of a mini gun. The first guide end will be described in more detail in the description of FIGS. 6A and 6B. The second guide end is attached to the booster assembly 108 and/or round repositioner 106 of a magazine 110. The second guide end will be described in more detail in the description of FIGS. 7A and 7B. When the mini gun is fired, belted ammunition stored in the magazine passes through the round repositioner and booster assembly, is guided through the feed chute links, and is fed to the feeder/delinker. The feeder/delinker strips rounds from their disintegrating belt links and supplies the rounds to the mini gun's breach mechanism.

Figure 2:
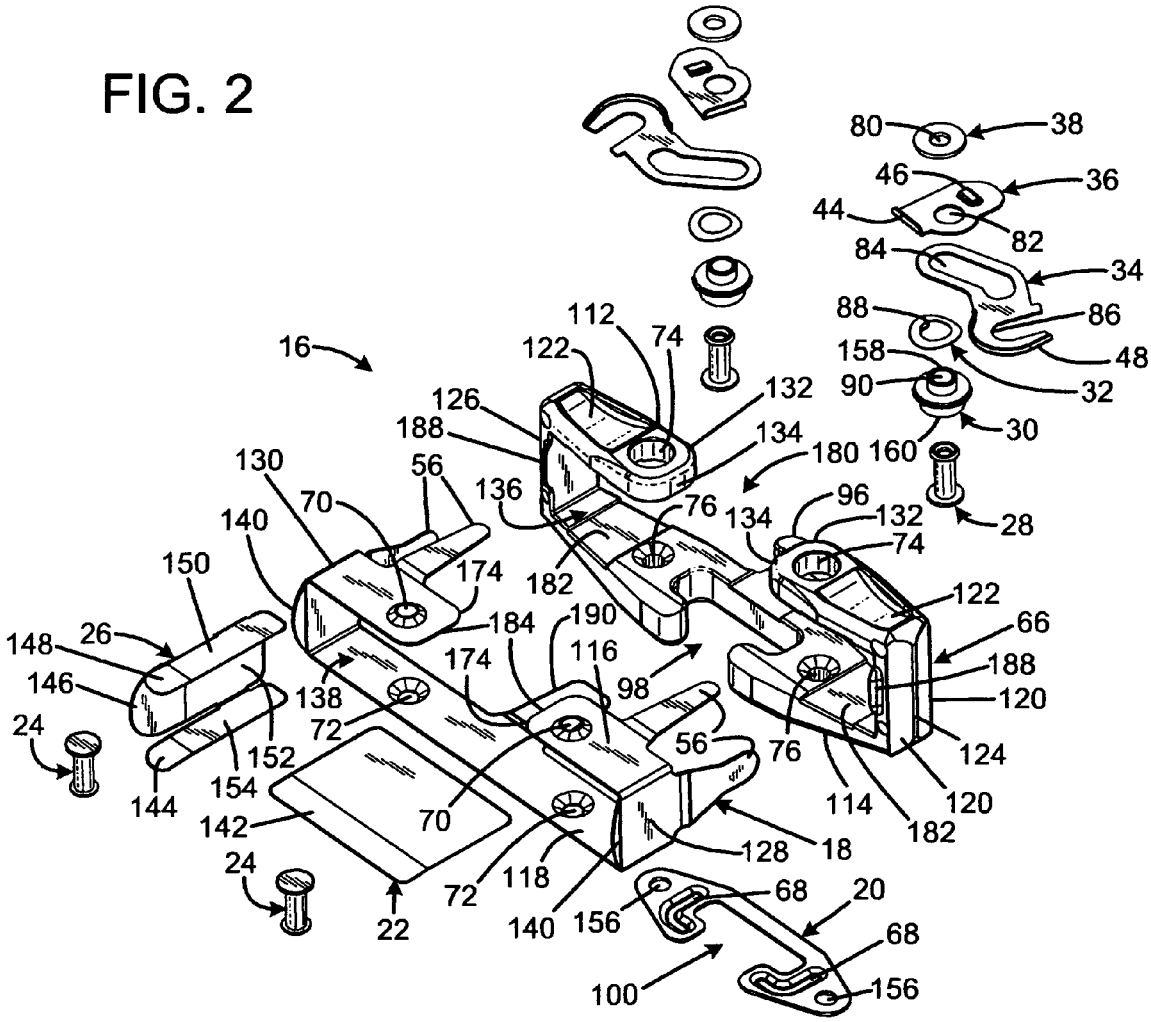
FIG. 2 is a top perspective exploded view of the ammunition feed chute of the present invention.

FIG. 2 illustrates the improved feed chute link 16 of the present invention. More particularly, the feed chute link has a plastic body 66 that provides the link with a strong backbone that resists crushing. An example of a suitable plastic is the glass-filled polyurethane Isoplast® manufactured by The Dow Chemical Company of Midland, Mich. This particular plastic features long glass fibers that make the body very strong.

The top 112, bottom 114, left 126, and right 124 sides of the body define a generally rectangular interior 136. The top is divided into two separate arms 132 with spaced apart ends 134 that point toward each other across a gap 180. Each arm features an aperture 74 at its end 134 and an indentation 122 adjacent to the aperture 74. The indentations exist to reduce the body's weight.

The bottom of the body is generally planar and features a central T-slot 98 that faces away from the magazine, a central T-tongue 96 that protrudes towards the magazine, two apertures 76 on either side of the T-slot 98, and two indentations 182 between the apertures 76 and the left and right sides of the body. The T-tongue and T-slot are sized to mate with similar features on adjacent links. The indentations 182 are relief clearances.

The left and right sides extend vertically upward from the ends of the bottom portion to connect the bottom to the top of the body. The left and right sides have scallops 120 on their external surfaces to reduce the body's weight. Rectangular tabs 188 are located on vertical surfaces of the left side 126 and right side 124 and are adjacent to scallops 120. The rectangular tabs keep the fingers 56 on the guide sleeve of the adjacent feed chute link from coming out of slots 178 (shown in FIG. 3) defined by a gap between the sides of the guide sleeve and the sides of the body when the feed chute links are flexed to their travel limit.

The scallops and indentations in the body reduce the body's weight by 4-6 g. The scallops and indentations are intended for installations on aircraft where weight minimization is essential and are optional for installations on ground-based vehicles.

The generally rectangular interior of the body receives a guide sleeve 18 having a top 116, bottom 118, left 130, and right sides 128. The top, bottom, left, and right sides of the guide sleeve define a generally rectangular interior 138. The top is divided into two separate arms 174. Each arm features an aperture 70 at its end 184. The apertures 70 are axially registered with the apertures 74 in the body. A finger 56 oriented horizontally extends towards the magazine from each of the arms. The fingers taper to a rounded end.

The bottom of the guide sleeve features two apertures 72. The apertures 72 are axially registered with the apertures 76 in the body. A center tab 190 on the guide sleeve extends forward from the bottom of the guide sleeve.

The left 130 and right 128 sides extend vertically to connect the bottom to the top of the guide sleeve. A finger 56 oriented vertically extends towards the magazine from both the left and the right sides. The fingers taper to a rounded end. The left and right sides also feature rounded portions extending away from the magazine.

The guide sleeve features nickel Teflon coated stainless steel. The coating provides a very smooth and low friction gliding surface for the belted ammunition.

A transitional surface panel is spot welded to the bottom of the guide sleeve 118 in the middle of the interior side. The transitional surface 22 is a thin, flat rectangular sheet of metal having a major surface with a slightly downward sloping lip 142. The transitional surface is nickel Teflon coated stainless steel and is positioned so that the lip protrudes from the bottom of the guide sleeve away from the magazine. The transitional surface covers its body's T-slot 98, the adjacent body's T-tongue 96, and overlaps the adjacent guide sleeve and transitional surface when they are assembled. The transitional surface eliminates any open gaps in the floor area of the feed chute and provides a smooth track for the belted ammunition as it passes between adjacent feed chute links.

The left side of the guide sleeve 18 receives a bullet guide 26. The bullet guide is spot welded to the left side wall of the guide sleeve, becoming part of the guide sleeve just like the transitional surface becomes part of the guide sleeve. The bullet guide is a thin sheet of folded metal having a top 150, bottom 154, and side 152. The vertical side joins the horizontal top and bottom together. The portions 148, 146, and 144 of the top, side, and bottom protrude from the guide sleeve away from the magazine and are flexible so that they can slide under (148 and 144) and over (146) the corresponding portions of the bullet guide in the neighboring feed chute link when the ammunition feed chute is assembled. The bullet guide is nickel Teflon coated stainless steel to provide a smooth gliding surface for the belted ammunition.

The bottom cover 20 is a thin plate of heat-treated stainless steel having a T-slot 100 that opens away from the magazine. Strengthening ribs 68 are positioned on either side of the T-slot and extend downwards from the bottom cover. Two apertures 156 are positioned on either end of the bottom cover. When the bottom cover is attached to the exterior underside of the bottom of the body, apertures 156 are axially registered with apertures 72 and 76 in the guide sleeve and body, and T-slot 100 is axially registered with T-slot 98 in the body. Rivets 24 pass through apertures 72, 76, and 156 to secure the bottom cover to the bottom of the body. As a result, the rivets 24 also secure the bottom of the guide sleeve to the bottom interior of the body.

Each of the apertures 74 in the top of the body receives the lower protrusion 160 portion of a top insert 30. Each top insert 30 also has an upper protrusion 158 and a central aperture 90.

A bowed washer 32 has a central aperture 88 that receives the upper protrusion of the top insert.

A ligament 34 is a sheet metal body that rests on top of the bowed washer and defines a closed angled slot 84 that receives the top upper protrusion 158 of the top insert. The ligament also has an open slot 86 that receives a rivet 28 of an adjacent feed chute link to removably attach the two feed chute links together. A raised edge wall 48 on the ligament reinforces the slot 86 to prevent the slot from failing. The ligament is made of heat-treated stainless steel.

A lock tab 36 has a central aperture 82 and sits on top of the ligament. The lock tab also includes a raised offset boss 46 and a raised edge wall 44 to enable interlocking of two adjacent feed chute links. The lock tab is made of heat-treated stainless steel.

An AN washer 38 has a central aperture 80 and sits on top of the lock tab. The AN designation refers to Army/Navy and denotes an aircraft-certified part.

Rivets 28 pass through apertures 70, 74, 90, 88, angled slot 84, 82, and 80 to secure the top insert, bowed washer, ligament, lock tab, and AN washer to each arm of the body. Once all the parts are in place, the rivet is crimped into position to hold the assembly together.

The bowed washer create spring pressure to compress the ligament between the AN washer and the lock tab. Once the ligament is positioned under the AN washer, the ligament is trapped or locked in by the lock tab of an adjacent feed chute link, the bowed washer applies upward pressure to prevent the ligament from disengaging from the lock tab. The raised offset boss 46 on the lock tab blocks the ligament from disengaging from the top insert, AN washer, and rivet by becoming trapped in the ligament's open slot 86. The upper protrusion 158 of the top insert is important because it locates these component parts, and the AN washer keeps the assembly together. When the top insert is machined on a CNC lathe, the dimensions are maintained precisely so there is an adequate amount of spring pressure and holding force exerted on all of these parts.

Each feed chute link 16 has two top inserts 30, two bowed washers 32, two ligaments 34, two lock tabs 36, and two AN washers 38. Each set of components is secured by a rivet 28 to an arm of the body.

Figure 3:
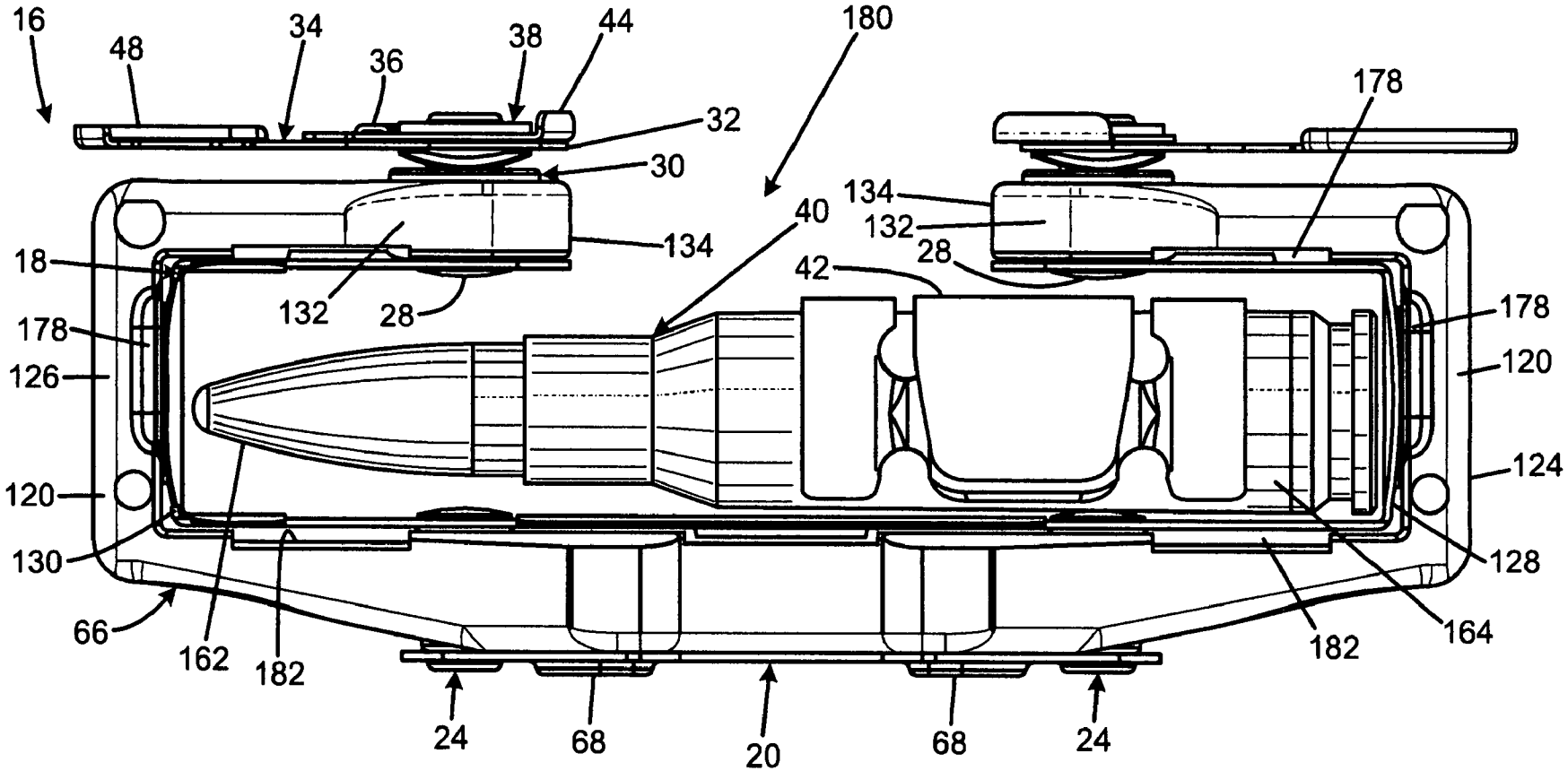
FIG. 3 is an end view of the ammunition feed chute of the present invention.

FIG. 3 illustrates a round of .308 ammunition 40 being guided through a feed chute link 16 of the present invention. More particularly, the cartridge 164 of the round of .308 ammunition is held by a link 42. The link 42 enables multiple rounds of ammunition to be linked together to form an ammunition belt. The round of ammunition is positioned within the interior 138 of the guide sleeve 18 so the bullet 162 slides through the guide sleeve on the left side 130 adjacent to the bullet guide 26. The cartridge is positioned so it slides through the guide sleeve adjacent to the right side 128. The guide sleeve, bullet guide, and transitional surface 22 define a guide path for the round of .308 ammunition to ensure the round and link pass smoothly through the interior of the guide sleeve. Slots 178 between the guide sleeve and the body 66 receive the fingers 56 of the adjacent, attached feed chute link.

Figure 4:
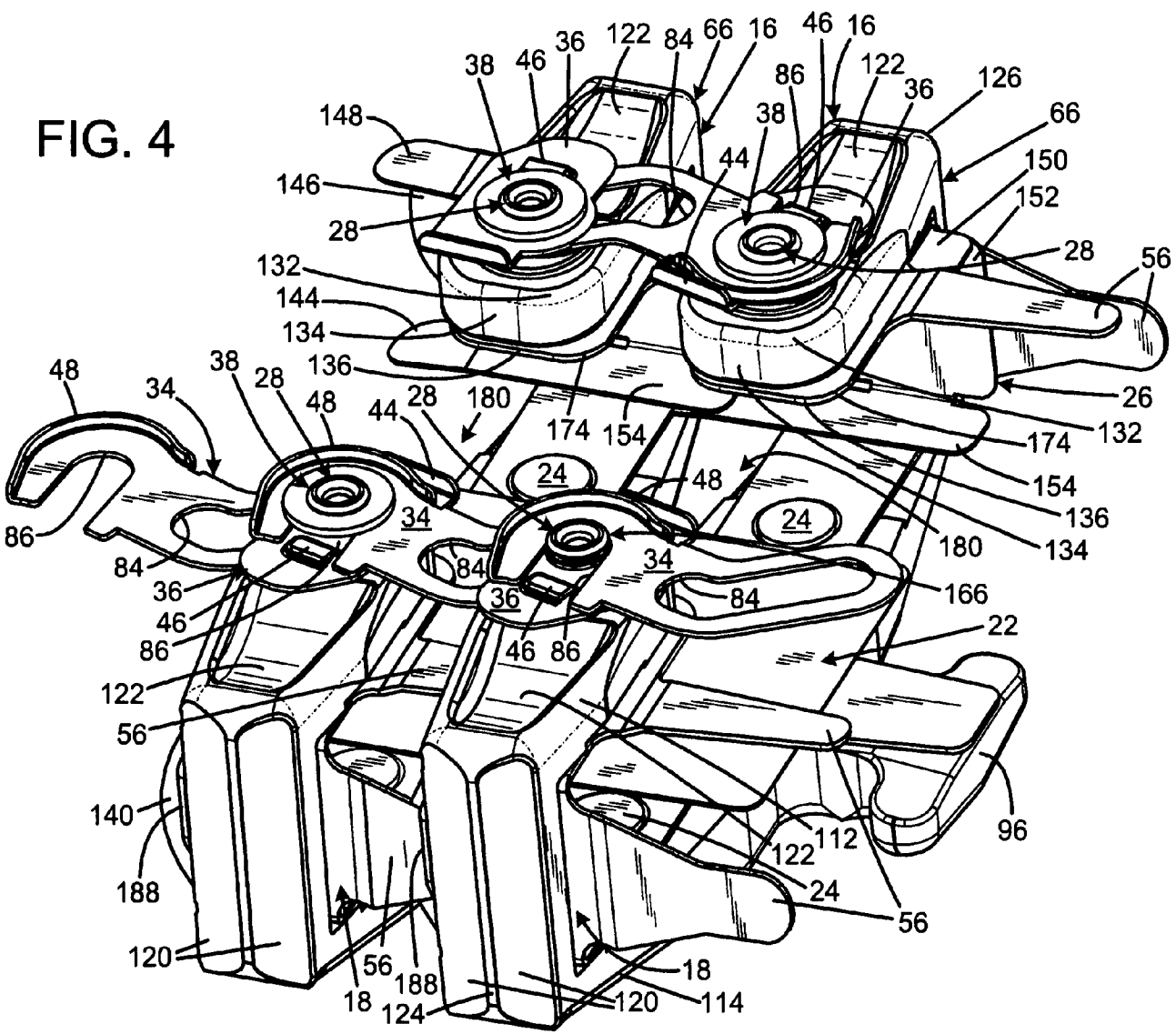
FIG. 4 is a top isometric view of two links of the ammunition feed chute of the present invention in their locked position.

FIG. 4 illustrates two feed chute links 16 of the improved ammunition feed chute 10 of the present invention connected together in their locked position. More particularly, the AN washer 38 that would normally be located at position 166 has been omitted from the illustration to show how the open slot 86 in the ligament 34 interacts with the lock tab 36 and that the open slot is fully engaged with the top insert's upper protrusion 158 and the received rivet 28. The raised wall 48 on the ligament strengthens that area of the ligament and provides a strong locating and lock surface. The raised boss 46 on the lock tab locates and locks into the open slot of the ligament. The raised wall 44 on the lock tab interacts with the raised wall on the ligament to further secure the ligament in place. The AN washer completes the top assembly and biases the ligament downward towards the locked position.

The two feed chute links are maneuvered into their locked position by positioning the two link bodies at a 90° angle to one another with the T-tongue 96 of a first feed chute link positioned immediately below and perpendicularly to the T-slot 98 of a second feed chute link. The two feed chute links are initially connected by sliding the T-tongue of the first feed chute link upward into the T-slots of the bottom cover and body of the second feed chute link. The bodies are then rocked into a 45° angle, and the fingers 56 of the first feed chute link are inserted into narrow slots 178 that are present between the guide sleeve 18 and the body 66 of the second feed chute link. Raising the two bodies so that they are coplanar guides the fingers into place and secures the T-tongue within the T-slot. In this position, the bullet guide 26 of the first feed chute link overlaps the tips 144 and 148 of the bullet guide 26 of the second feed chute link. The tip 146 of the bullet guide 26 of the second feed chute link overlaps the bullet guide 26 of the first feed chute link. The transitional surface 22 of the second feed chute link overlaps the transitional surface of the first feed chute link. The ligaments of each of the feed chute links are then aligned with the lock tabs of the adjacent feed chute link. Each ligament's open slot is slipped into position under the AN washer around the upper protrusion 158 of the top insert and the rivet. Once the ligaments are in position, the lock tabs are rotated 90° to secure them.

Although the feed chute links are securely locked together, the connecting components still impart a wide amount of flexibility to the feed chute. The overlapping surfaces of the bullet guides and transitional surfaces present a smooth surface for a belted ammunition to glide across while simultaneously enabling lateral bending movements of the feed chute links by sliding with respect one another. The T-slots and T-tongues interact with each other to constrain movement of the bottom of the feed chute. The lock tabs and ligaments control movement of the top of the feed chute. Specifically, the length and angle of the slot 84 in the ligaments determines the range of movement. The length and angle are not less than 0.384 in. and 50° to enable sufficient flexibility of the feed chute and not greater than 0.484 in. and 50° to prevent the belted ammunition from bending more than it is capable of without clogging.

Figure 5:
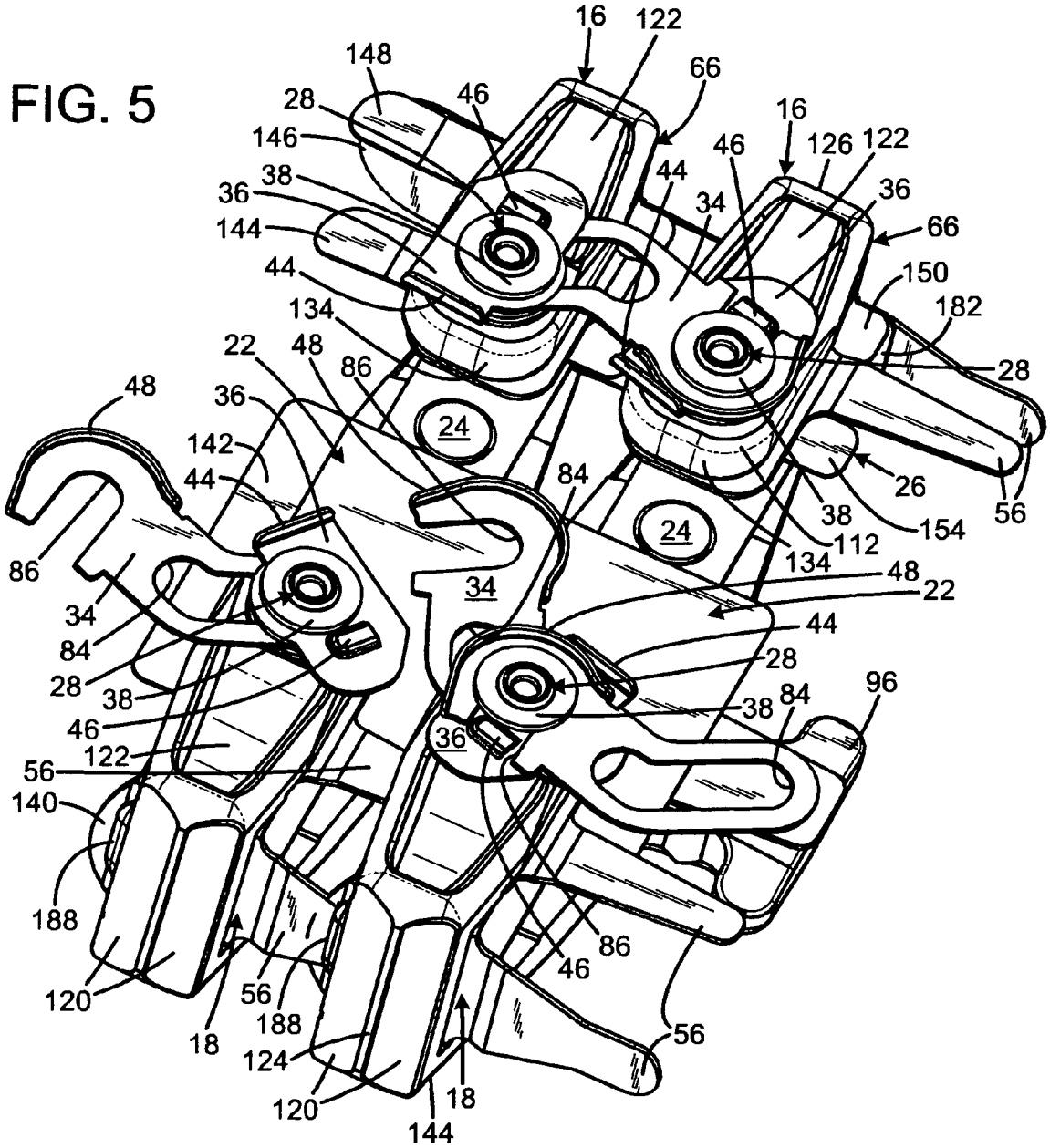
FIG. 5 is a top isometric view of two links of the ammunition feed chute of the present invention in their unlocked position.

FIG. 5 illustrates two feed chute links 16 of the improved ammunition feed chute 10 of the present invention in their unlocked position. More particularly, the illustration shows one ligament 34 and one lock tab 36 that have been unlocked. To unlock the feed chute links, the side of the lock tab with the raised boss 46 is pressed down, the lock tab is rotated until its raised wall 44 has cleared the raised wall 48 of the ligament, and then the ligament is rotated out from its locked position by pulling the open slot 86 clear of the AN washer and the rivet 28. Once the operation is repeated on the other side of the feed chute, the two links can be separated by pulling them apart and bending the feed chute until the two links are at a 90° angle to disengage the T-tongue 96 from the T-slot 98. The use of the ligaments and lock tabs enables any two feed chute links to be separated from each other and subsequently reattached without requiring any tools. This enables ammunition jams within the feed chute to be easily cleared, or damaged links to be replaced or removed, so the feed chute can be rapidly returned to service.

When attached, all the interior sheet metal guides overlap in the manner of fish scales, with the free edges of each tab and sheet extending in the direction of ammunition flow, providing a low friction passage.

Figure 6A:
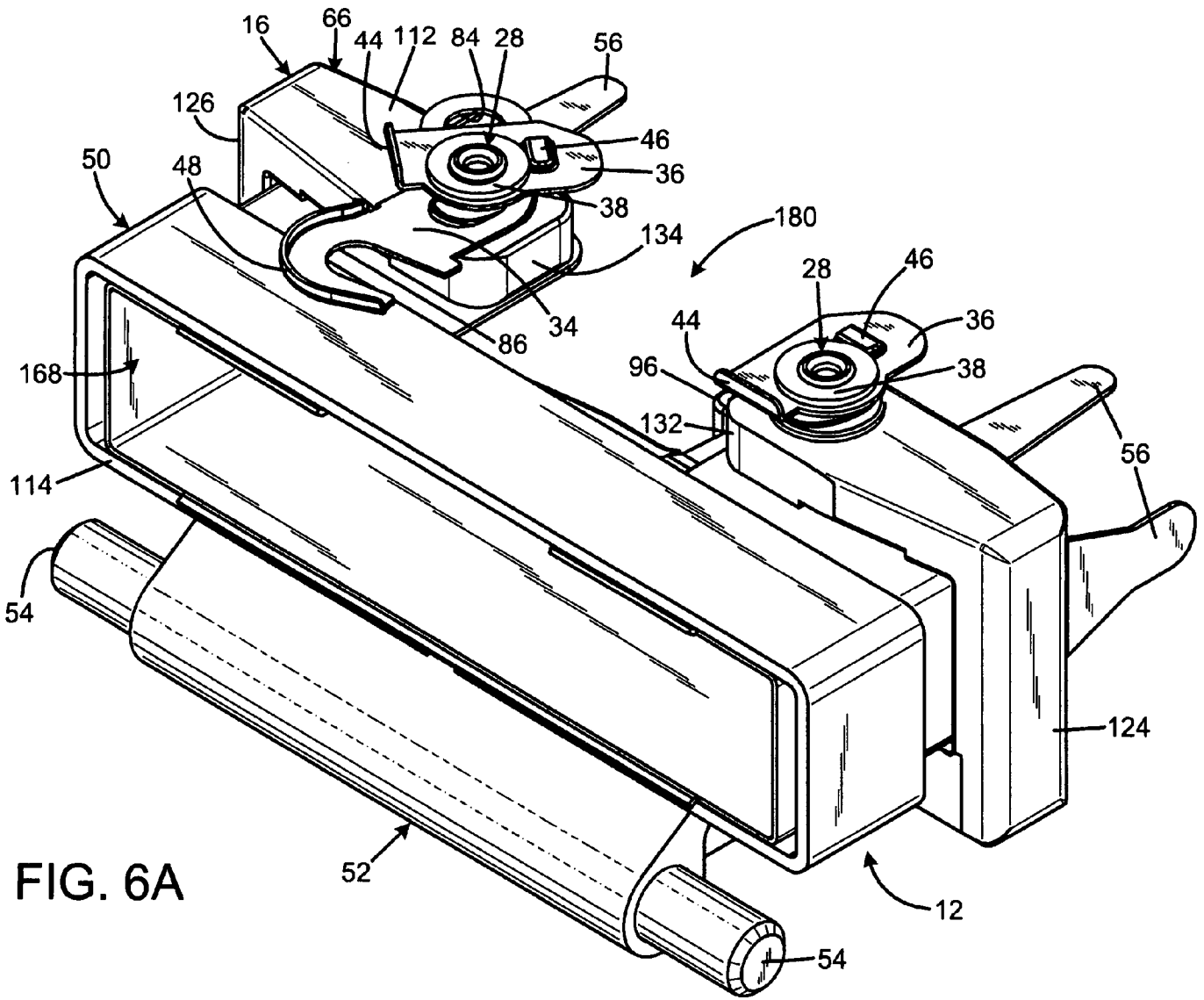
FIG. 6A is a top isometric view of the first guide end of the ammunition feed chute of the present invention.
Figure 6B:
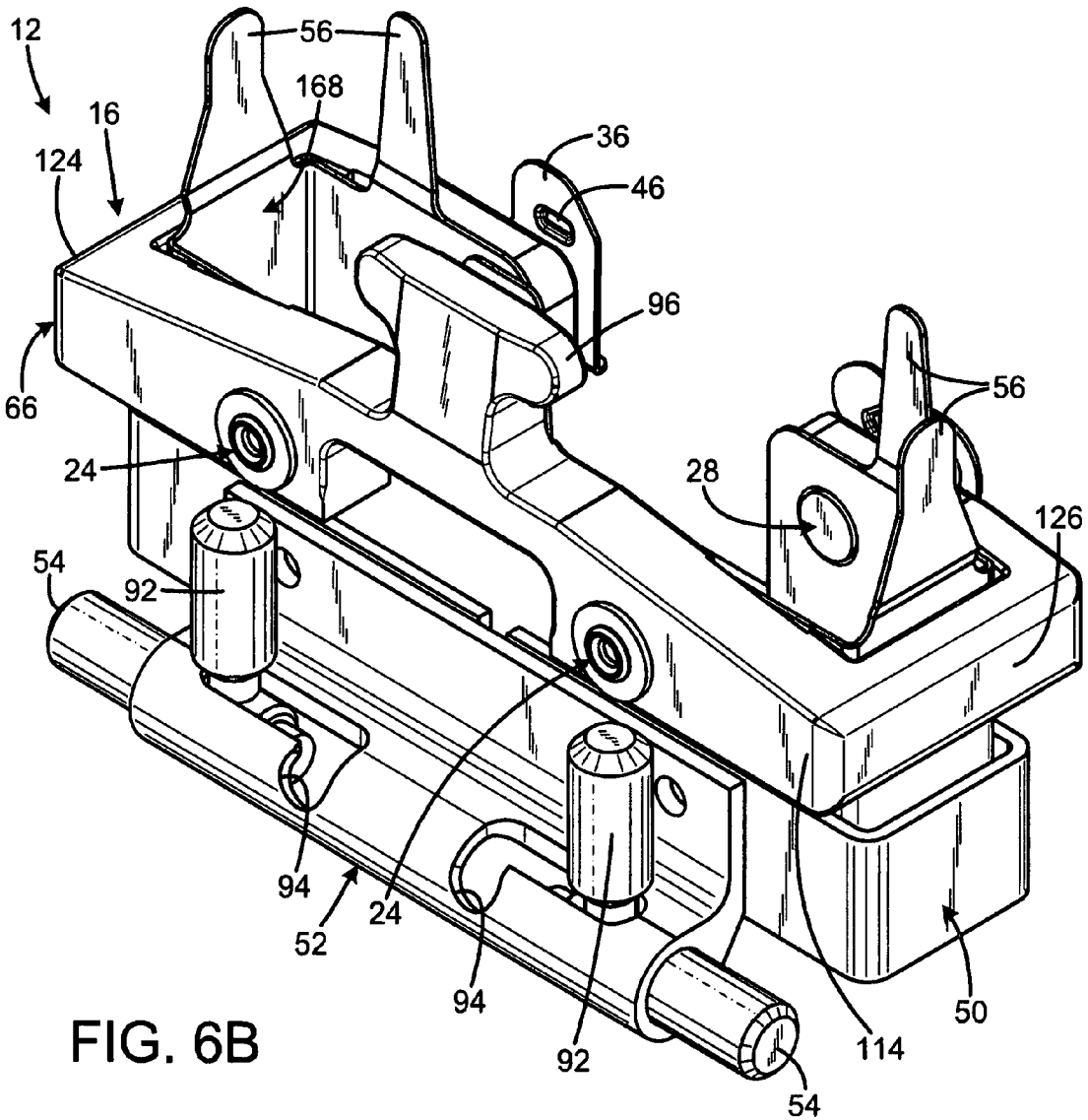
FIG. 6B is a bottom isometric view of the first guide end of the ammunition feed chute of the present invention.

FIGS. 6A and 6B illustrate the first guide end 12 of the ammunition feed chute 10 of the present invention. More particularly, the first guide end connects the feed chute to the feeder/delinker 104 of a mini gun. The first guide end features a lengthened guide sleeve 168 that is riveted to a feed chute link body 66. The guide sleeve 168 is lengthened so it protrudes from the body towards the mini gun. A skin doubler 50 is spot welded over the protruding portion to provide extra strength to the guide sleeve at that location. A latch body assembly 52 is an extruded metal body that is spot welded to the bottom of the skin doubler. The latch body assembly receives two spring-loaded spring pins 54 at either end. The spring pins 54 attach the feed chute to the side of the mini gun. The ligaments 34 and lock tabs 36 that are part of the first guide end enable the first guide end to be easily connected to any quantity of feed chute links 16 to enable the length of the overall feed chute to be completely customizable. The lengthened guide sleeve, skin doubler, and latch body assembly are all nickel Teflon coated stainless steel.

To attach the feed chute to the mini gun's feeder/delinker, two finger pins 92 that are connected to the spring pins are squeezed together and moved within L-shaped holding slots 94 towards the middle of the latch body assembly to retract the spring pins into the latch body assembly. The bottom portion of the L-shaped holding slots retains the finger pins and holds the spring pins in their retracted position until the latch body assembly is positioned properly on the side of the mini gun's feeder/delinker. The finger pins are then released, causing the spring pins to spring out from the latch body assembly into apertures 102 to attach the feed chute to the mini gun's feeder/delinker.

Figure 7A:
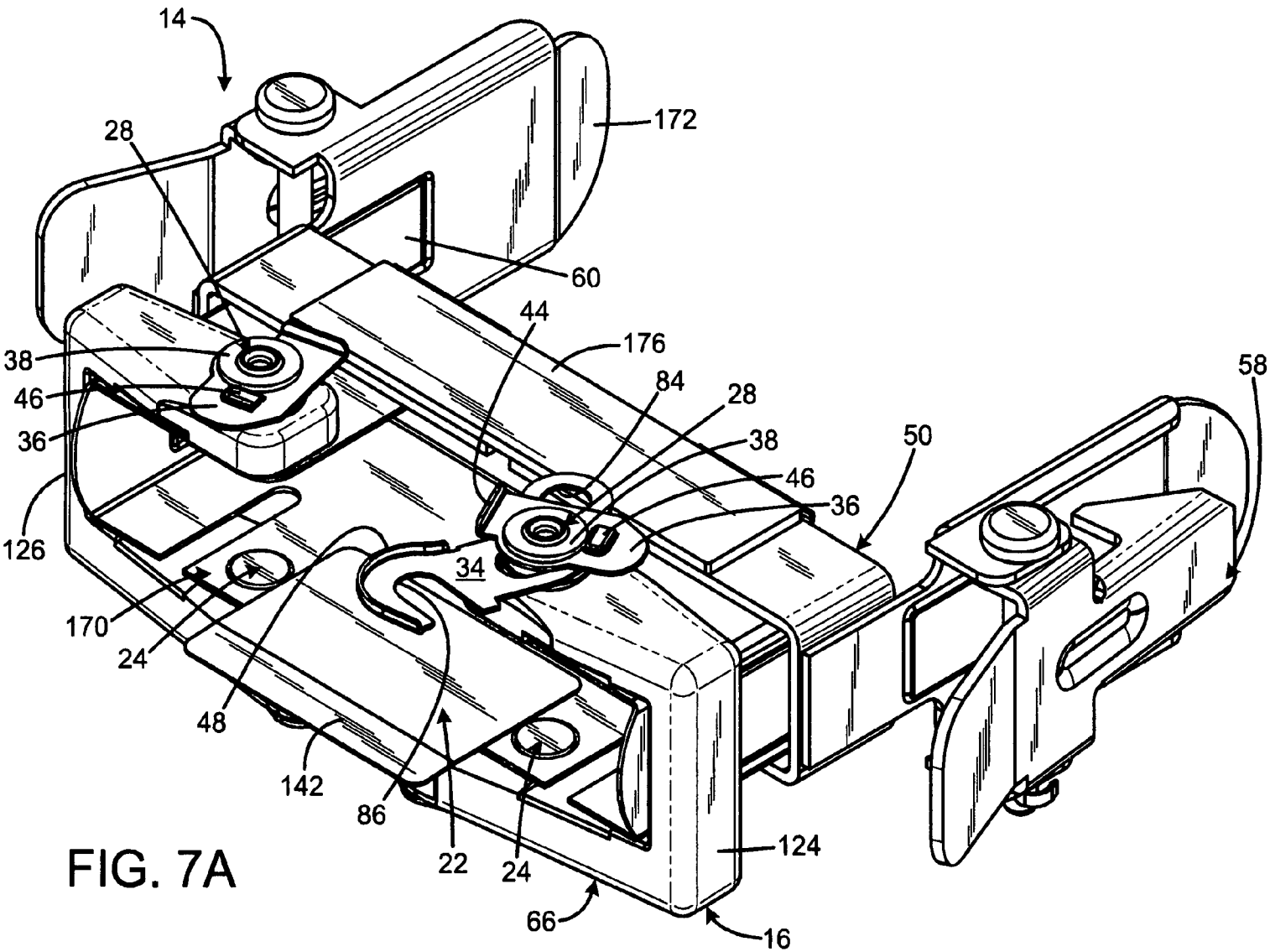
FIG. 7A is a top isometric view of the second guide end of the ammunition feed chute of the present invention.
Figure 7B:
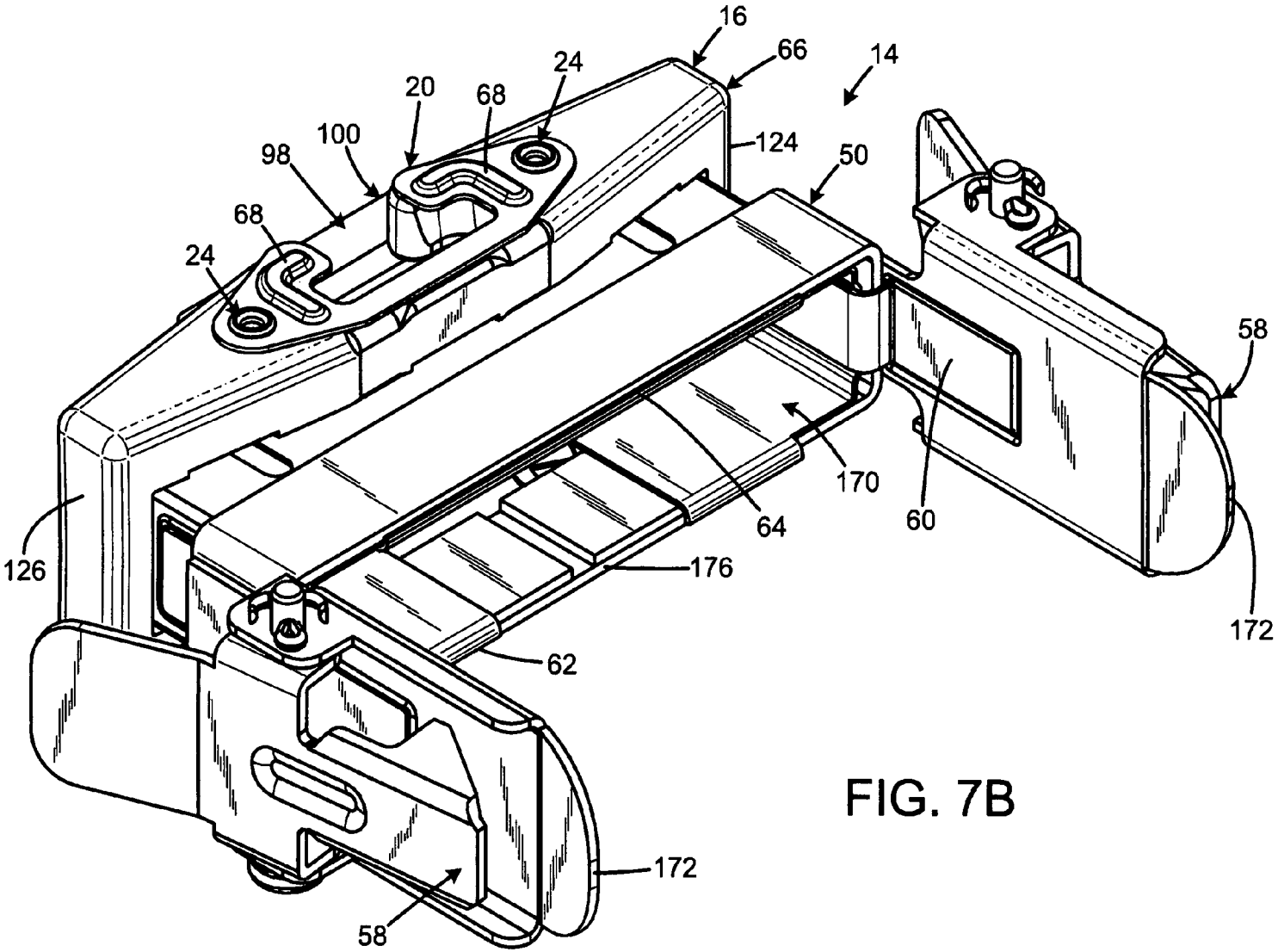
FIG. 7B is a bottom isometric view of the second guide end of the ammunition feed chute of the present invention.

FIGS. 7A and 7B illustrate the second guide end 14 of the ammunition feed chute 10 of the present invention. More particularly, the second guide end connects the feed chute to the booster assembly 108 and/or round repositioner 106 of a magazine 110. The second guide end features a lengthened guide sleeve 170 that is riveted to a feed chute link body 66. The guide sleeve 170 is lengthened so that it protrudes from the body towards the magazine. A transitional surface 22 is spot welded to the bottom interior of the guide sleeve and extends away from the magazine. A skin doubler 50 is spot welded over the protruding portion to provide extra strength to the guide sleeve at that location. Two latch mounting brackets 172 are spot welded onto the sides of the skin doubler and guide sleeve and received tab guides 60. The latch mounting brackets extend towards the magazine and are angled outwards. A crossover plate 176 is spot welded to the top side of the skin doubler. Two O.S. hooks 58 are attached to the outer surface of the latch mounting brackets. The O.S. hooks are designed to fit slots 186 present on opposing sides of the standard booster transmission and/or round repositioner of a standard magazine. A torsion spring is used to provide spring tension on the O.S. hooks to secure them in place when they are attached to the magazine. The ligaments 34 and lock tabs 36 that are part of the second guide end enable the second guide end to be easily connected to any quantity of feed chute links 16 to enable the length of the overall feed chute to be completely customizable.

The guide sleeve 170, transitional surface, skin doubler, latch mounting brackets, crossover plate, O.S. hooks, and tab guides are all nickel Teflon coated stainless steel. The tab guides have a smooth radiused profile, and the top 64 and bottom 62 edges of the second guide end have smooth radiused surfaces, which enable belted ammunition to pass smoothly from the magazine through the second guide end and into the feed chute.

To attach the feed chute to the magazine, the O.S. hooks are squeezed together to open them. The O.S. hooks are then slipped into position. The O.S. hooks are then released, causing the O.S. hooks to spring closed and attach the feed chute to the magazine.

While a current embodiment of the ammunition feed chute has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, while mini guns as described are the most likely contemplated application for the concepts of the present invention, it should be appreciated that the current invention could be used with any type of firearm utilizing belted ammunition.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An ammunition feed chute comprising:

a plurality of feed chute links releasably connected together;

wherein a tongue extending from one of the feed chute links is received and retained by a slot in an adjacent feed chute link to releasably connect the feed chute links together, the feed chute links having interior surfaces that define a guide path for belted ammunition;

each of the feed chute links having a transitional surface attached to one of the feed chute link's interior surfaces, the transitional surfaces each extending from the interior surface to which it is attached to a location where it overlaps the adjacent feed chute link's transitional surface;

wherein the transitional surface of the feed chute link having a slot covers the slot and the adjacent feed chute link's tongue.

2. The ammunition feed chute of claim l wherein the transitional surfaces are attached to the bottom of the feed chute link in the middle of the feed chute link's interior side.

3. The ammunition feed chute of claim 1 wherein the tongue and slot are T-shaped.

4. The ammunition feed chute of claim 1 wherein the tongue and slot interact with one another to constrain the range of movement of the bottoms of the feed chute links with respect to one another.

5. The ammunition feed chute of claim 1 wherein the tongue of one of the feed chute links can be inserted into and removed from the slot in an adjacent feed chute link by hand without requiring a tool.

6. An ammunition feed chute comprising:

a plurality of feed chute links releasably connected together;

the feed chute links having interior surfaces that define a guide path for belted ammunition;

each of the feed chute links having a connection facility and a movable connector; and each of the connectors being operable to releasably connect to the connection facility of an adjacent link;

wherein each connector includes an open slot and a closed slot;

wherein each connector receives the connection facility of one of the feed chute links within its closed slot and removably receives the connection facility of an adjacent feed chute link within its open slot to releasably connect the feed chute links together;

each connection facility having a lock tab rotatably attached thereto;

each lock tab including a raised boss; and wherein each connector receives the raised boss of the lock tab attached to the connection facility received within the connector's open slot to releasably secure the connection facility within the connector's open slot.

7. The ammunition feed chute of claim 6, farther comprising each connection facility having a bowed washer attached thereto, the bowed washer springedly biasing the lock tab against the connector.

8. The ammunition feed chute of claim 6 wherein the connectors' closed slots and the connection facilities received thereby interact with one another to constrain the range of movement of the tops of the feed chute links with respect to one another.

9. The ammunition feed chute of claim 6 wherein the connectors' closed slots have a length of about 0.384 in. and are angled at about 50°.

10. The ammunition feed chute of claim 6 wherein the connection facility of one of the feed chute links can be inserted into and removed from the open slot in an adjacent feed chute links connector by hand without requiring a tool.

* * * * *